US006824420B2

(12) United States Patent
Ushiro et al.

(10) Patent No.: US 6,824,420 B2
(45) Date of Patent: Nov. 30, 2004

(54) ELECTRIC CONNECTOR WITH CABLE HOLDING MECHANISM

(75) Inventors: Yutaka Ushiro, Yokohama (JP); Katsuyuki Masaki, Yokohama (JP); Yusuke Hamada, Yokohama (JP)

(73) Assignee: J.S.T. Mfg. Co., Ltd., Osaka (JP)

( * ) Notice: Subject to any disclaimer, the term of this patent is extended or adjusted under 35 U.S.C. 154(b) by 0 days.

(21) Appl. No.: 10/309,111

(22) Filed: Dec. 4, 2002

(65) Prior Publication Data

US 2003/0109169 A1 Jun. 12, 2003

(30) Foreign Application Priority Data

Dec. 6, 2001 (JP) ..... 2001-373447

(51) Int. Cl.[7] ..... H01R 13/58
(52) U.S. Cl. ..... 439/455; 439/468; 439/902
(58) Field of Search ..... 439/460, 463, 439/450–456, 466, 468, 902

(56) References Cited

U.S. PATENT DOCUMENTS 3,794,960 A * 2/1974 Sugar ..... 439/459
3,936,129 A * 2/1976 Guy ..... 439/464
4,035,051 A * 7/1977 Guy ..... 439/464
4,722,580 A * 2/1988 Kocher et al. ..... 439/466
4,842,547 A * 6/1989 Defibaugh et al. ..... 439/460
4,842,549 A * 6/1989 Asick et al. ..... 439/464
5,389,006 A * 2/1995 Noschese ..... 439/354
6,106,325 A * 8/2000 Kuo ..... 439/455
6,139,355 A * 10/2000 Puerner ..... 439/473

* cited by examiner

*Primary Examiner*—Hae Moon Hyeon
(74) *Attorney, Agent, or Firm*—Armstrong, Kratz, Quintos, Hanson & Brooks, LLP

(57) ABSTRACT

There is provided an electric connector for simplifying the structure of the cable holding mechanism without using a special cable holding piece, reducing the number of man-hours by simplifying the operation of attaching the cable holding mechanism to a connector housing. The electric connector with a cable holding mechanism comprises a plug proper having a plurality of connector terminals fitted therein at an inner opening thereof and a cable drawing face from which wires connected to the connector terminals is drawn out, a cover cap to be fitted to the plug proper in a state where the cable drawing face is covered therewith and the cable is drawn outside, and a cable holding mechanism formed on a wall face of the cover cap. The cable holding mechanism is made up of two vertical grooves each having a width in which a flexible strip-like piece of a cable bundling piece is inserted at a position in the vicinity of a cable drawing opening formed at the inner face of the cover cap.

5 Claims, 7 Drawing Sheets

ELECTRIC CONNECTOR WITH CABLE HOLDING MECHANISM

FIELD OF THE INVENTION

The invention relates to an electric connector with a cable holding mechanism, particularly to an electric connector with a cable holding mechanism provided with a cable bundling piece for bundling wires.

BACKGROUND OF THE INVENTION

With a conventional electric connector from which a cable connected to a connector terminal is drawn out from a direction opposite to a direction of insertion through the electric connector, if a tensile force is applied to the cable, the tensile force is directly transmitted to the connector terminal. If the tensile force becomes strong, there occur drawbacks in that the connector terminal and the cable are disconnected from each other or a part (a lance) of the connector terminal which is retained inside a connector housing is deformed to cause the connector terminal not to be retained by the housing, thereby causing the connector terminal to be removed from the connector housing.

There is known a first method, for solving these drawbacks, of fixedly attaching a cable to a housing using a specially shaped fixing piece to prevent a tensile force from directly applying to a connector terminal or a second method of attaching a cover to a back face of a connector housing so as to draw out a cable backward after the cable is once bent.

The first method is, for example, disclosed in JU-A 63-3076 and the second method is, for example, disclosed in JP-A 11-329574.

An electric connector as disclosed in JU-A 63-3076 comprises, as shown in FIG. 7, a block 100 having a contact which is inserted into or removed from the block 100, and a contact hood 101 for covering a connection part between the contact and a cable when the contact hood 101 is retained by the block 100. A base table 102 is formed on the contact hood 101 for attaching a cable clamp 104 at a position in the vicinity of a cable drawing opening, and the cable clamp 104 fixed to the base table by screws 103 so as to clamp an outer periphery of a cable 105 so that a tensile force is not applied to the connection part.

An electric connector with a cable holding piece as disclosed in JP-A 11-329574 comprises, as shown in FIGS. 8(A) and 8(B), a pair of holding plates 110A, 110B, a narrow width part 111 for connecting between the holding plates, and a clamp 112 for bundling wires which are drawn out from a back face of a connector housing provided at one of the holding plates. When the cable holding piece is attached to the connector housing, the narrow width part 111 is inserted into an insertion groove 113 provided in the connector housing, so that the narrow width part 111 is retained by a slot part and is prevented from being removed therefrom. As a result, each wire is bent along the back face of the connector housing, then it is arranged backward, and hence a tensile force does not directly act on terminals provided inside the connector housing even if the tensile force is applied to each wire.

However, with these electric connectors described above, a special metal fitting or a specially shaped holding piece for fixing a cable is needed to be prepared in advance in addition to the connector housing, and the connector housing is needed to be molded in a special shape so that the special metal fitting or the like can be attached to the housing.

Accordingly, there has arisen a problem in that not only work for attaching the special metal fitting or the like to the housing is bothersome, but also the number of components increases because a metal fitting and components for fitting the metal fitting or the like are required, and then a manufacturing cost of the electric connector is increased because a molding process of the housing is bothersome.

SUMMARY OF THE INVENTION

The invention has been developed to solve the problems described above and an object of the invention is to provide an electric connector with a cable holding mechanism for simplifying the structure of the cable holding mechanism without using a special cable holding piece, reducing the number of man-hours by simplifying work for attaching the cable holding mechanism to the connector housing, and reducing a manufacturing cost.

The object of the invention can be achieved by the following means and structure.

The electric connector with a cable holding mechanism according to the invention comprises a plug proper having a plurality of connector terminals fitted therein at an inner opening thereof and a cable drawing face from which wires connected to the connector terminals is drawn out, a cover cap to be fitted to the plug proper in a state where the cable drawing face is covered therewith and the cable is drawn outside, and a cable holding mechanism formed on wall faces of the cover cap, characterized in that the cable holding mechanism is made up of grooves each having a width in which a flexible strip-like piece of a cable bundling piece is inserted at a position in the vicinity of a cable drawing opening of the cover cap.

The grooves are formed to have a width in which the strip-like piece of the cable bundling piece is inserted into the wall faces of the cover cap, and the strip-like piece of the cable bundling piece is inserted into and fixedly attached to the grooves. As a result, the shape of the grooves is simplified so that the fabrication of the grooves is easy.

It is preferable that the cable bundling piece bundles a plurality of wires and comprises the flexible strip-like piece having a given width and thickness, ratches at one face thereof, and a retainer provided at the tip end of the flexible strip-like piece for engaging with one of the ratches.

Since the cable bundling piece has been already known, an additional special fastener or the like is not needed because the cable bundling piece can be used for the cable holding mechanism.

Further, it is preferable that the grooves are made up of convex projections which are wider than a width of the strip-like piece of the cable bundling piece and are arranged in parallel with each other, and a height of the convex projections is approximately the same as a thickness of the strip-like piece.

Still further, it is preferable that the grooves are made up of two inner projections which are wider than a width of the strip-like piece of the cable bundling piece and are arranged in parallel with each other, and outer convex projections provided in the vicinity of the outside of the two inner convex projections, wherein a height of the respective convex projections is approximately the same as a thickness of the strip-like piece, and the tip end of the outer convex projections is longer than that of the inner convex projections.

More still further, it is preferable that the respective convex projections are provided on opposite wall faces of the cover cap, and the strip-like piece of the wire bundling piece is engaged and inserted between the opposite inner convex projections.

Since these grooves are made up of convex projections, the shape thereof is simplified and is formed with ease. Further, since the cable holding mechanism can be fixedly attached to the connector housing by merely pushing the strip-like piece of the wire bundling piece between the convex projections, it can be fitted into the connector housing without using tools or the like with ease.

BRIEF DESCRIPTION OF THE DRAWINGS

FIGS. 1(A) and 1(B) show a plug for constituting an electric connector of the invention and a receptacle connected to the plug, wherein FIG. 1(A) is a perspective view showing a state of connection between the plug and the receptacle, and FIG. 1(B) is a perspective view showing a state of disconnection between the plug and the receptacle;

FIGS. 2(A) to 2(C) show components of the electric connector which are separated from each other in a state of disconnection between the plug and the receptacle, wherein FIG. 2(A) is a perspective view of the receptacle, FIG. 2(B) is a perspective view of the plug from which a cover is detached, and FIG. 2(C) is a perspective view of a plug cover;

FIGS. 3(A) and 3(B) show the plug wherein FIG. 3(A) is a side view of the plug as seen from arrows A—A in FIG. 2(B), and FIG. 3(B) is a side view of the plug as seen from arrows B—B in FIG. 2(B);

FIGS. 4(A) to 4(C) show a cover cap, wherein FIG. 4(A) is a plan view, FIG. 4(B) is a front view of the cover cap as seen from arrows A—A in FIG. 4(A), and FIG. 4(C) is a side view of the cover cap as seen from arrows B—B in FIG. 4(A);

FIGS. 5(A) to 5(C) show a state where a multi-wire cable is fitted on the plug, wherein FIG. 5(A) is a plan view of the plug wherein a part of the cover is broken, FIG. 5(B) is a sectional view taken along arrows A—A in FIG. 5(A), and FIG. 5(C) is a side view as seen from arrows B—B in FIG. 5(A);

PREFERRED EMBODIMENT OF THE INVENTION

An embodiment of the invention is described hereinafter with reference to the accompanying drawings. It is to be pointed out however that the invention is not limited thereto, and various modifications may be made therein by methods that will be described hereinafter as necessary without departing from the spirit of the invention. Structures and functions of such modifications will be easily understood and apparent from the description of the present embodiment, omitting therefore description thereof.

Figure 1A:
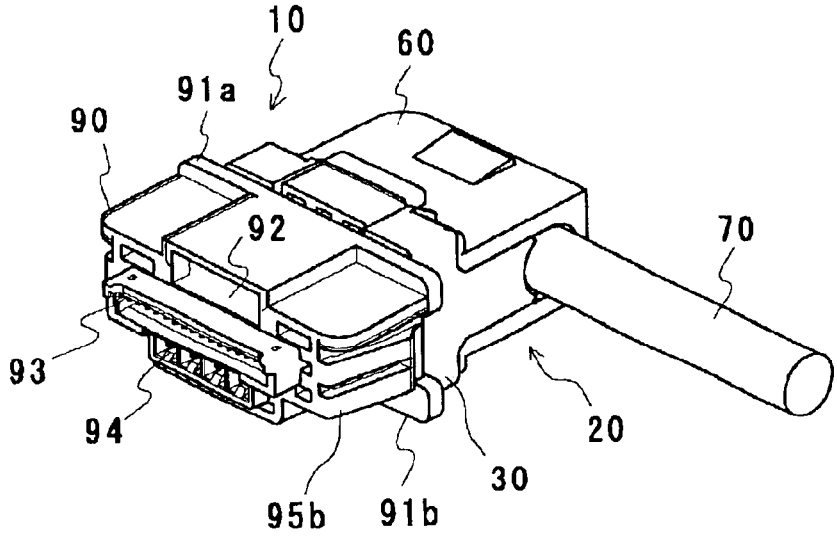
Figure 1B:
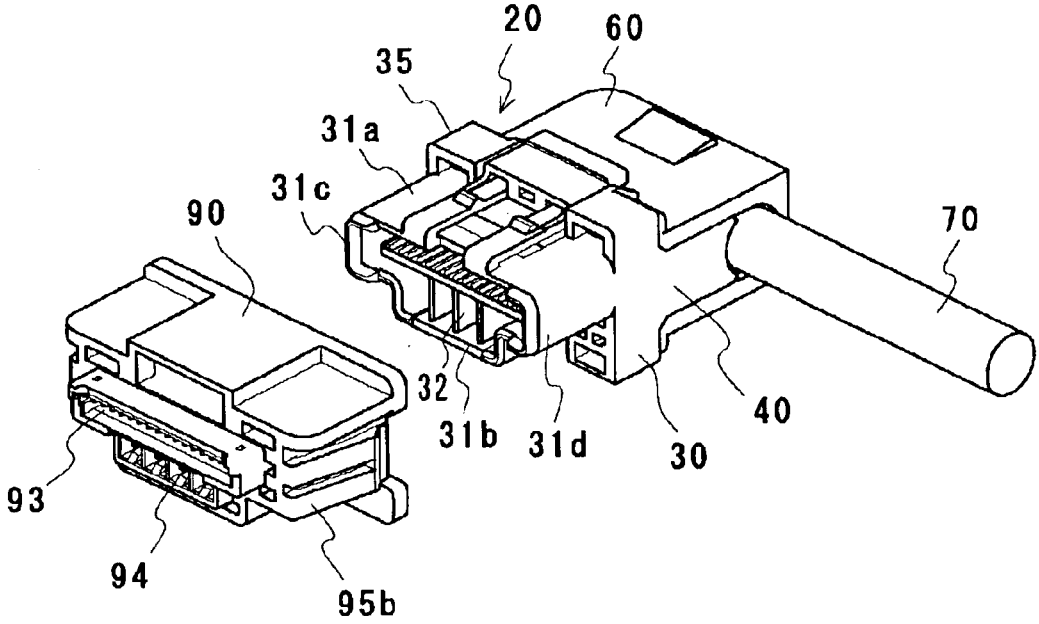
Figures 2A, 2B, 2C:
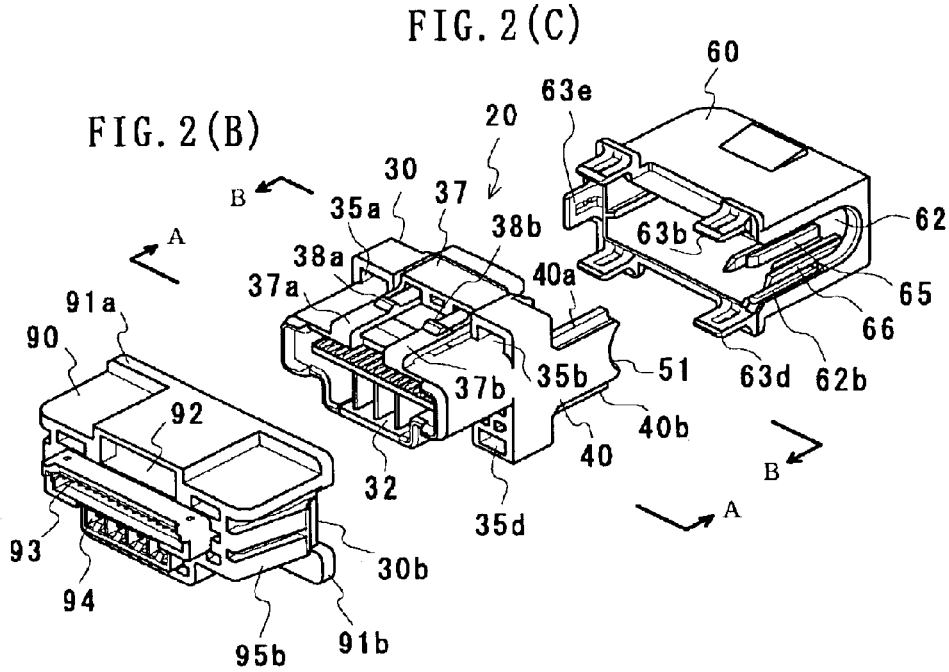
Figure 3A:
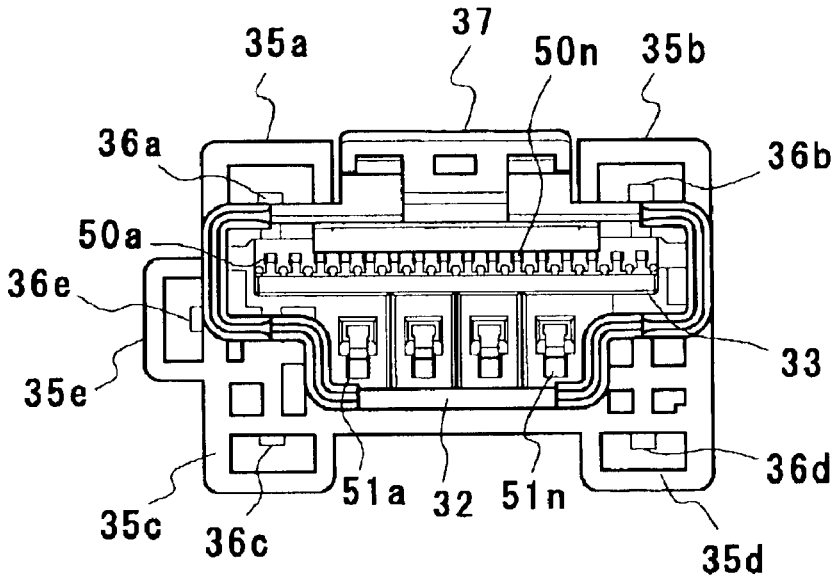
Figure 3B:
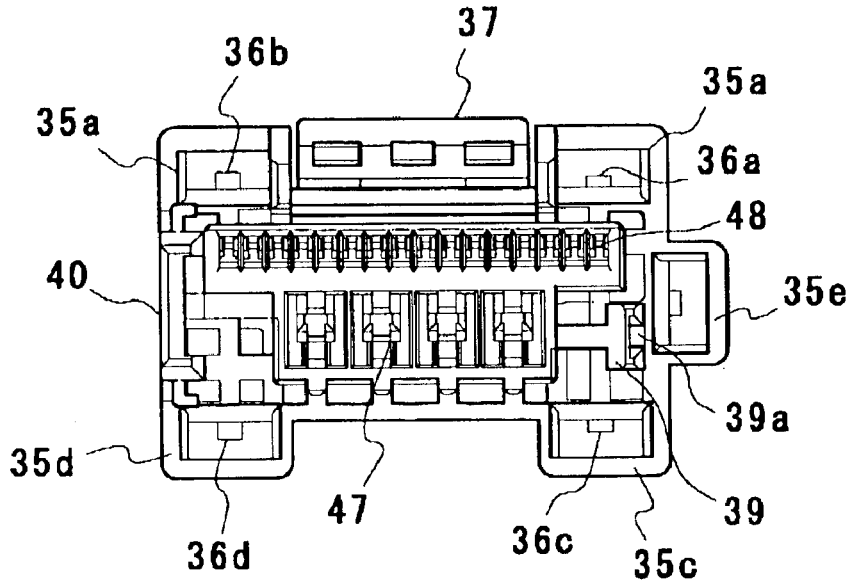

FIGS. 1(A) and 1(B) show a plug for constituting an electric connector of the invention and a receptacle connected to the plug, wherein FIG. 1(A) is a perspective view showing a state of connection between the plug and the receptacle, and FIG. 1(B) is a perspective view showing a state of disconnection between the plug and the receptacle. FIGS. 2(A) to 2(C) show components of the electric connector which are separated from each other in a state of disconnection between the plug and the receptacle, wherein FIG. 2(A) is a perspective view of the receptacle, FIG. 2(B) is a perspective view of the plug from which a cover is detached, and FIG. 2(C) is a perspective view of a plug cover. FIGS. 3(A) and 3(B) show the plug wherein FIG. 3(A) is a side view of the plug as seen from arrows A—A in FIG. 2(B), and FIG. 3(B) is a side view of the plug as seen from arrows B—B in FIG. 2(B).

In FIGS. 1(A) and 1(B), an electric connector 10 comprises a plug-type connector (hereinafter referred to merely as plug) 20 and a receptacle-type connector (hereinafter referred to as merely receptacle) 90 removably connected to the plug 20. The plug 20 includes a plug proper 30, connector terminals fitted in the plug proper 30, and a cover cap 60 removably fitted on the plug 20 so as to cover a connection part between the connector terminals and lead wires.

The plug proper 30 is made up of a housing in flat block shape housing and comprises upper and lower walls 31*a*, 31*b*, left and right sidewalls 31*c*, 31*d*, a flange 35 projecting externally from a peripheral wall surface of these sidewalls, and an opening 32 through which the connector terminals are fitted in the housing, and it is formed of an insulating synthetic resin material.

In FIGS. 3(A) and 3(B), the flange 35 has projecting chamber 35*a* to 35*e* at both end portions of the upper and lower wall faces 31*a*, 31*b* and a substantially central portion of the left sidewall 31*c*, each having walls erected from each wall face thereof, wherein the erected wall are formed in a position where the erected wall ends are flush with each other. Further, these projecting chambers 35*a* to 35*e* are formed openings, and retainer protrusions 36*a* to 36*e* are formed at substantially the central portions of these openings. The retainer protrusions 36*a* to 36*e* formed inside the projecting chambers 35*a* to 35*e* are engaged with attachment ports of a cover cap 60, described later, to fixedly attach the cover cap 60 thereto.

In FIG. 2(B), the plug proper 30 is divided, at front end of the flange 35 as the boundary, into a front housing, and a back housing. The front housing has the upper and lower walls 31*a*, 31*b* and the left and right sidewalls 31*c*, 31*d*, and an external shape thereof is substantially the same as the shape of an opening of the receptacle, described later, in which the front housing is inserted. Strip-like elastic engagement arms 37*a*, 37*b* which are bent back from the tip end of the opening 32 and extended horizontally are formed on the upper wall face 31*a*, and the tip ends of the elastic engagement arms 37*a*, 37*b* are connected to each other at a presser piece 37. Engagement pawls 38*a*, 38*b* are provided on the elastic engagement arms 37*a*, 37*b* at a center part of length of each of the strip-like elastic engagement arms 37*a*, 37*b*.

The elastic engagement arms 37*a*, 37*b* are structured such that when the plug 20 is connected to the receptacle 90, engagement pawls 38*a*, 38*b* of the elastic engagement arms 37*a*, 37*b* enter concaves of the receptacle 90 (not shown) so that the plug 20 is coupled with the receptacle 90. When the receptacle 90 is removed from the plug 20, the presser piece 37 is pressed downward by a finger so as to release the engagement between the engagement pawls 38*a*, 38*b* and the concaves of the receptacle 90, thereby releasing the coupling between the receptacle 90 and the plug 20.

Further, in FIG. 3(A), the opening 32 is provided in the front housing through which a plurality of connector terminals are fitted in the housing, and it links with a space part of the back housing. A deck 33 is provided in the opening 32 at a approximately central part thereof and extends widthwise and a plurality of grooves are formed on the upper face of the deck 33 through which connector terminals are fitted in the opening 32. The lower face of the deck 33 is partitioned by a plurality of spaced walls and different kinds of connector terminals 50*a* to 50*n*, 51*a* to 51*n* are fitted in chambers formed by the grooves and partition walls.

The back housing is structured that an outer wall of the opening 32 of the front housing projects from the flange 35 to a back wall end, and insertion holes in which the connector terminals are inserted and a cable drawing face through which lead wires connected to each connector terminal are formed in the space part linking with the opening 32. Further, as shown in FIG. 3(B), a pair of protruding pieces 39, 40 extended from the left and right sidewalls 31*c*, 31*d* of the front housing are provided in the back housing wherein one protruding piece 39 is formed narrower while the other protruding piece 40 is formed wider. A guide groove 39*a* is provided on the central portion of the narrow protruding piece 39 outside and extended axially. As shown in FIG. 2(B), the tip end of the wide protruding piece 40 is formed in a circular-arc concave shape in which an outer shape of the cable is engaged and has guide protrusions 40*a*, 40*b* which extend axially while providing steps at both ends thereof in a width direction.

Further, the interior of the back housing is partitioned by a plurality of spaced walls, and chambers are formed by the grooves and spaced walls, wherein different kinds of connection terminals are fitted in these grooves and chambers. These openings are linked with the opening of the front housing and are connected to terminals to be fitted in the front housing.

On the hand, as shown in FIGS. 1(A) and 1(B), the receptacle 90 to be coupled with the plug 20 is made up of a housing in flat block shape and comprises upper and lower walls and left and right sidewalls, a flange protruding externally from these peripheral walls, elastic retainer arms provided at both sidewalls for engaging an attachment port of a panel (only one retainer arm 95*b* is shown in FIG. 1(B)), and an opening through which the connector terminals are fitted in the housing. The opening is formed to have approximately the same shape as the shape of the opening of the plug 20, through which the plug 20 is inserted, and an opening linked with this opening is formed at the side opposite to the opening, namely, a side opposite to the connection direction of the plug. A plurality of connection pins 93 which are removably connected to other connectors (not shown) are embedded into these openings, and a plurality of chambers 94, through which terminals with lead wires (not shown) are fitted therein, are formed in these openings.

Figure 4A:
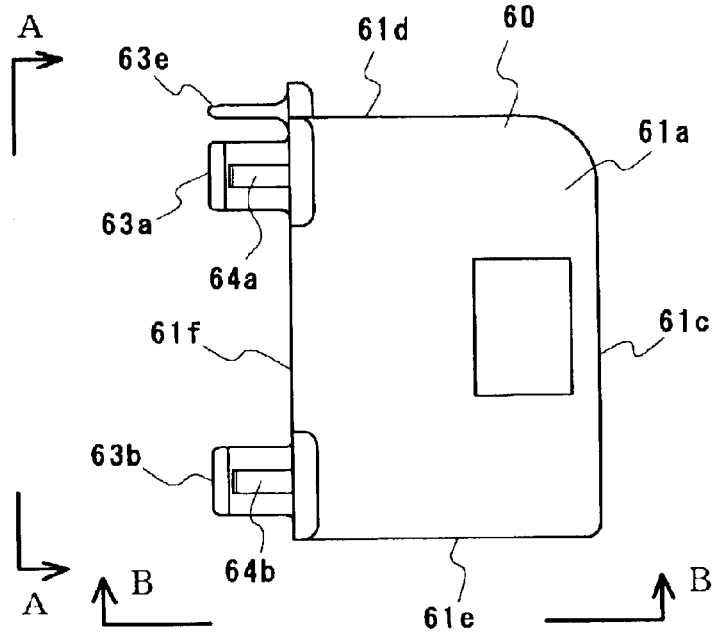
Figure 4B:
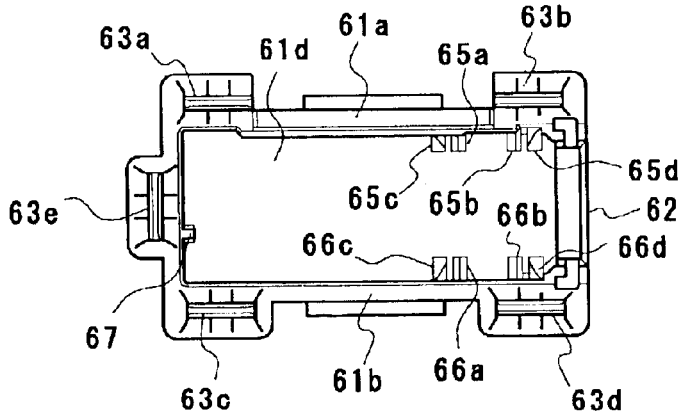
Figure 4C:
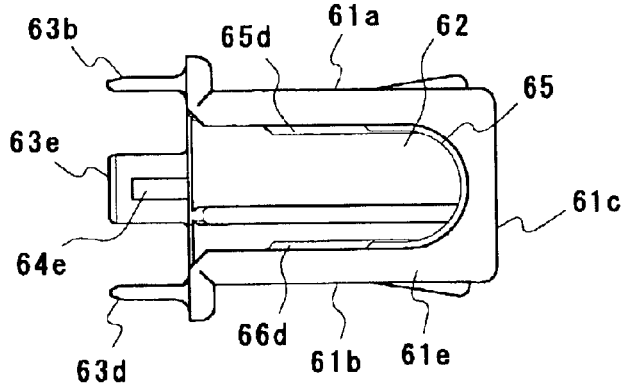

FIGS. 4(A) to 4(C) show a cover cap, wherein FIG. 4(A) is a plan view, FIG. 4(B) is a front view of the cover cap as seen from arrows A—A in FIG. 4(A), and FIG. 4(C) is a side view of the cover cap as seen from arrows B—B in FIG. 4(A).

The cover cap 60 is provided to be removably fitted on the plug proper in a state where it covers a lead wire drawing face connected to the connector terminals while a cable is drawn outside, and it is made up of a flat box which is opened at a side through which the cover cap 60 is fitted on the plug proper 30 and a side through which the cable is drawn out. This box body is closed at peripheral sidewalls 61*c*, 61*d*, and is opened at the sidewall 61*e* through which the cable is drawn out and at a sidewall 61*f* through which the cover cap 60 is fitted on the plug proper 30. An opening 62 of the sidewall 61*e* is substantially formed of a U-shaped groove. As shown in FIGS. 2(B) and 2(C), grooves 62*a*, 62*b* (one of the grooves, the lower groove 62*b* is disclosed in FIG. 2(C)) to be engaged with the guide protrusions 40*a*, 40*b* are formed on end faces of the U-shaped groove 62, and an opening through which the cable can be inserted between itself and the tip end of the protruding piece 40, namely, sidewall 40 when the cover cap 60 is fitted on the plug proper 30 is formed at the innermost part of the groove.

Retainer protrusions 63*a* to 63*e* are formed at four corners of the opened sidewall 61*f* and the tip end of one sidewall 61*d*, and retainer holes 64*a* to 64*e* are formed on the retainer protrusions 63*a* to 63*e*. The retainer holes 64*a*, 64*b*, are shown in FIG. 4(A) and the retainer hole 64*e* is shown in FIG. 4(C) while the remaining retainer holes 64*c*, 64*d* are omitted in illustration.

The cover cap 60 has convex projections 65, 66 disposed in the vicinity of the opening 62 and provided on upper and lower inner wall faces 61*a*, 61*b* in which the wire is retained (see FIG. 4(B)). The convex projections 65, 66 formed on the upper and lower inner wall faces 61*a*, 61*b* comprise four convex projections 65*a* to 65*d*, 66*a* to 66*d* in which two protrusions are paired while they are substantially in parallel with the sidewall 61*e*. Intervals between the inner convex projections 65*a*, 65*b* on the upper wall face and the inner convex projections 66*a*, 66*b* on the lower wall face are slightly wider than a width of a cable stopper, described later. Each height of the convex projections 65*a*, 65*b* and 66*a*, 66*b*, that is, an interval between the inner convex projections 65*a*, 65*b* of the upper wall face and the inner convex projections 66*a*, 66*b* of the lower wall face are set such that the cable stopper is inserted into the interval and is set at a height where the cable stopper is retained thereby. Further, the outer convex projections 65*c*, 65*d* are formed at positions in the vicinity of the inner convex projections 65*a*, 65*b* while the outer convex projections 66*c*, 66*d* are formed at positions in the vicinity of the inner convex projections 66*a*, 66*b*, wherein the height of the outer convex projections is substantially the same as that of the inner convex projections.

Each tip end of the inner and outer convex projections provided on the upper and lower wall inner faces is configured that each tip end of the outer convex projections 65*c*, 65*d* and 66*c*, 66*d* is extended to be longer than that of the inner convex projections 65*a*, 65*b* and 66*a*, 66*b*.

Since each tip end of the outer convex projections is extended to be slightly longer than that of the inner convex projections, when the cable stopper is inserted from the tip end of the convex projections, the width of the outer convex projections functions as a guide of the cable stopper relative to the inner convex projections, simplifing operation at the narrow spot.

Although the convex projections are made up of the inner and outer convex projections, they may be made up of only the inner convex projections while the outer convex projections are dispensed with. Further, although the convex projections are formed on both the upper and lower wall faces, they may be formed on either the upper or lower wall face. Needless to say, such modification will entail modification in the shape of the convex projections according to the shape of the cable stopper. Further, the cable stopper is not only inserted from the tip end of the convex projections but also inserted from above and fixedly attached to the convex projections by such modification.

Although the cover cap set forth above is fitted on the plug 20, it is applicable to the receptacle. The receptacle in this case is different from the type depicted by 90 shown in FIG. 1(B), wherein the connection pins 93 are changed to connector terminals with lead wires and a multiple-wire cable is used.

Although the cover cap 60 set forth above is made up of a flat box, the shape thereof is not limited thereto, and hence they may have any optional shape such as square, round, or the like. Accompanied by the modification in shape of the cover cap 60, the opening through which the wires or a multi-wire cable is drawn out may be provided at a rear wall confronting the plug proper but not provided at the side wall in the vicinity of the plug proper. In this case, since the opening is provided at the rear wall, it is not necessary to bend the cable inside the cover cap, both ends of two inner convex projections may form inclined outward so as to insert the cable stopper from both ends in the longitudinal direction, facilitating the insertion of the cable stopper.

Further, the outer convex projections may be also formed like the aforesaid inner convex projections, and the tip end of the inner and outer convex projections may be formed such that the outer convex projections are slightly longer than the inner convex projections at tip ends thereof.

The cable 70 is structured such that it includes a multi-wire cable and has been already known and has a plurality of lead wires 71*a* to 71*i* therein, wherein these lead wires are covered with a sheath.

Figure 6:
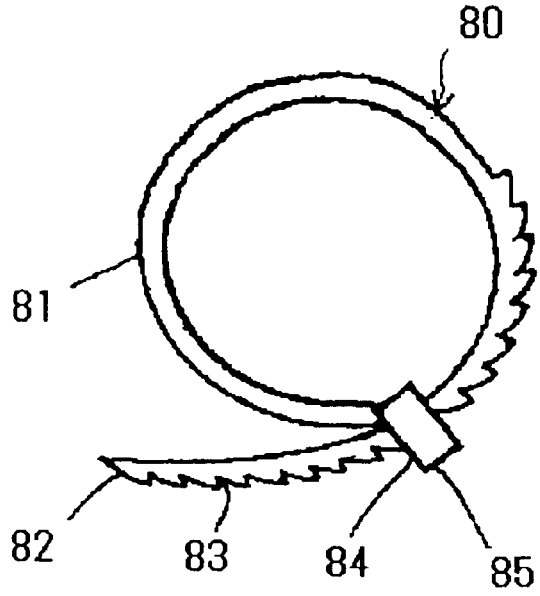
FIG. 6 PRIOR ART
FIG. 6 is a side view showing a known cable bundling piece.
Figure 7:
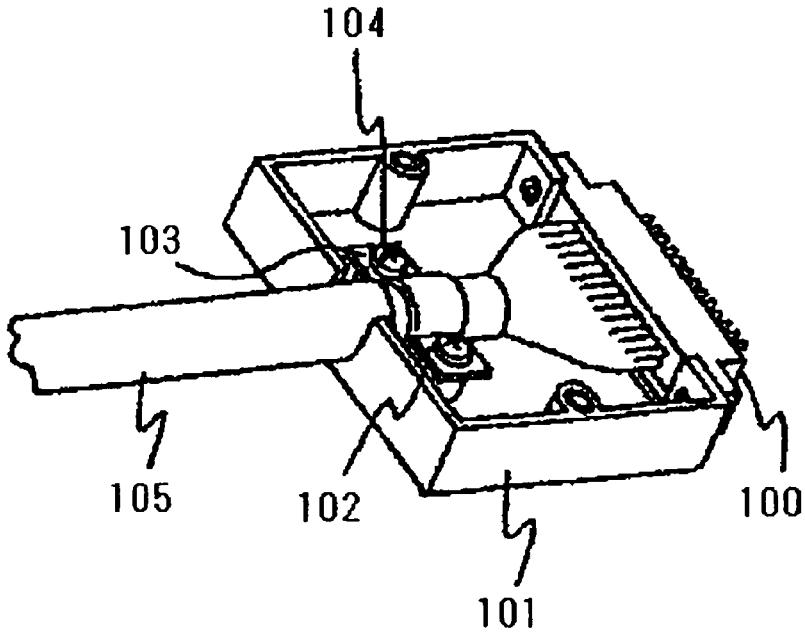
FIG. 7 PRIOR ART
FIG. 7 shows a conventional electric connector with a cable holding mechanism.
Figure 8A:
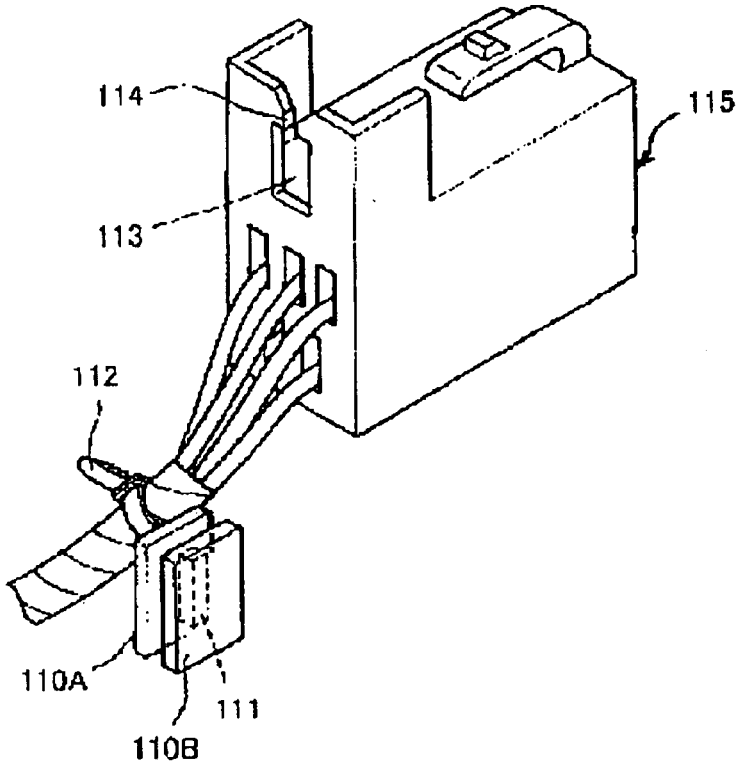
FIG. 8(A) PRIOR ART
FIGS. 8(A) and 8(B) show a conventional electric connector with a cable holding piece.
Figure 8B:
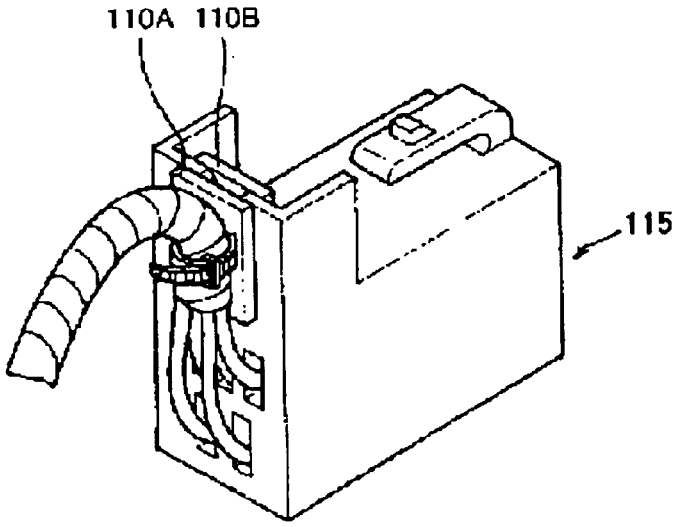
FIG. 8(B) PRIOR ART

A cable stopper 80 is fastened to the sheath in the vicinity of the portion where the sheath of the cable 70 is stripped off. A cable bundling piece made of synthetic resin and is easily available on a market (see FIG. 6) is used as the cable stopper 80. The structure of the cable stopper 80 is configured such that it is formed of a flexible strip-like piece 81 normally having a given width and thickness with a square frame-like retainer 85 at the tip end thereof, and having a plurality of ratches 83 along half length to the tip end 82 on one surface thereof. The retainer 85 can be inserted into the strip-like piece 81 and a hook 84 is formed to be flexible and deformable at the opening edge of the retainer 85 for removably retaining one of the ratches 83.

A method of fixing a multi-wire cable to a plug is described next with reference to FIGS. 5(A) to 5(C).

Figure 5A:
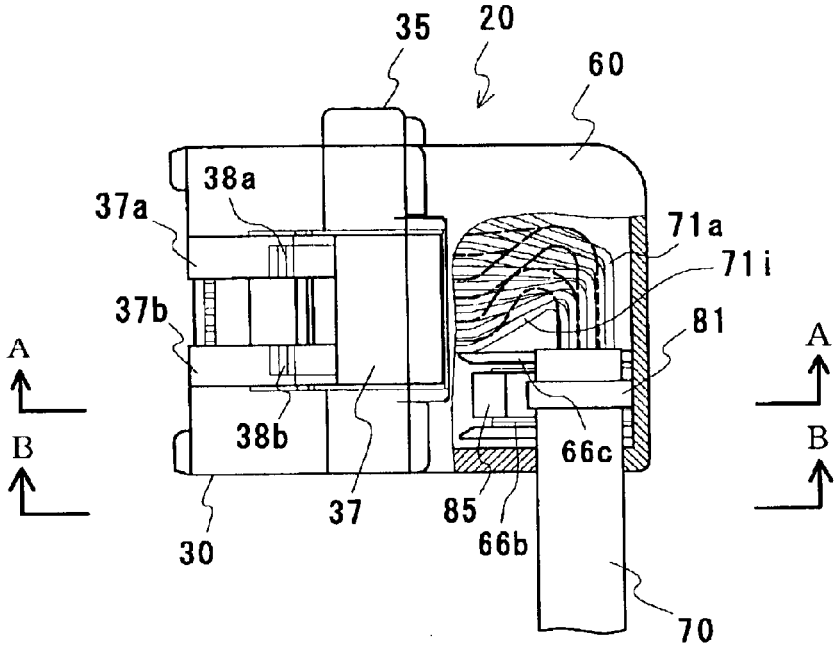
Figure 5B:
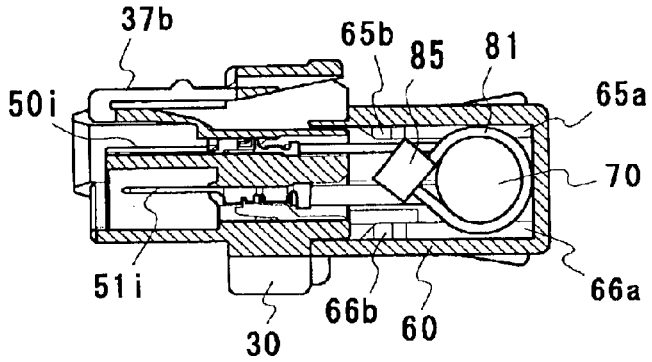
Figure 5C:
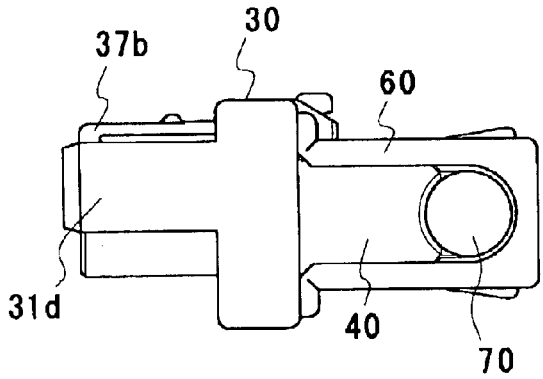

FIG. 5(A) shows a state where the multi-wire cable is fitted on the plug, and it is a plan view of a cover cap a part of which is broken, FIG. 5(B) is a sectional view taken along arrows A—A in FIG. 5(A), and FIG. 5(C) is a side view as seen from arrows B—B in FIG. 5(A).

First of all, the sheath of the multi-wire cable 70 at the tip end thereof is stripped off to separate the lead wires into independent lead wires, wherein respective connector terminals (depicted by 50*i*, 51*i* in FIG. 5(B)) are connected to respective tip ends of the lead wires.

The strip-like piece 81 of the cable stopper 80 (hereinafter referred to as cable bundling piece 80) is turned around the periphery of the sheath in the vicinity of the portion where the sheath of the multi-wire cable 70 is stripped off, and the tip end 82 of the strip-like piece 81 is inserted into the opening of the retainer 85 and fastened to the periphery of the sheath.

When one of the ratches 83 of the strip-like piece 81 is retained by a pawl 84, the strip-like piece which is extended from the retainer 85 is cut so as to fix the cable bundling piece 80 to the multi-wire cable 70. When the cable bundling piece 80 is fixed to the multi-wire cable 70, a diameter of the outer periphery of the multi-wire cable 70 to which the cable bundling piece 80 is fixed increases at a width portion of the strip-like piece 81 by the thickness thereof.

The increased diameter of the multi-wire cable 70, namely, the thicker portion of the multi-wire cable 70 is utilized as the cable stopper. That is, the retainer 85 is fastened to the sheath of the multi-wire cable 70 so as to direct towards the plug proper 30, and a loop-shaped portion of the strip-like piece 81 is pressed into the convex projections. Since the tip end of the outer convex projections 65*c*, 65*d* and 66*c*, 66*d* is extended to be longer than that of the inner convex projections 65*a*, 65*b* and 66*a*, 66*b*, the outer convex projections 65*c*, 65*d* and 66*c*, 66*d* function as a guide of the strip-like piece 81 and the strip-like piece 81 are simply pushed between the inner convex projections 65*a*, 65*b* and 66*a*, 66*b*, so that the loop-shaped portion of the strip-like piece 81 is fixed between the inner convex projections 65*a*, 65*b* and 66*a*, 66*b* of the cover cap 60.

Subsequently, the multi-wire cable 70 is fixedly attached to the cover cap 60, and the connector terminals 50, 51 connected to the multi-wire cable 70 are fitted in the opening of the plug proper 30, then the retainer protrusions 63*a* to 63*e* of the cover cap 60 are inserted into the chamber 35*a* to 35*e*. By the insertion of the retainer protrusions 63*a* to 63*e*, the retainer holes 64*a* to 64*e* of the retainer protrusions 63*a* to 63*e* are engaged with the retainer projections 36*a* to 36*e* of the chambers 35*a* to 35*e* so that the cover cap 60 is fixedly attached to the plug proper 30. The cover cap 60 may be fixedly attached to the multi-wire cable 70 and it may be fitted on the plug proper 30 after the connector terminals 50, 51 are fitted in the opening of the plug proper 30.

With the electric connector with a cable holding mechanism according to the invention as set forth above, the structure of the cable holding mechanism can be simplified without using a special cable holding piece, the operation of attaching the cable holding mechanism to a connector housing is simplified, thereby reducing the number of man-hours, and also reducing a manufacturing cost.

What is claimed is:

1. An electric connector with a cable holding mechanism comprising:

a plug proper having a plurality of connector terminals fitted therein at an inner opening thereof and a cable drawing face from which wires connected to the connector terminals are drawn out;

a cover cap to be fitted to the plug proper in a state in which the cable drawing face of said plug proper is covered therewith whereby a cable can be drawn outside; and a cable holding mechanism including an opening formed in a cable drawing face of the cover cap to cooperate with an edge of a protruding piece of the plug proper;

the opening in the cover cap having spaced protrusions defining grooves each having a width in which a flexible strip-like piece of a cable bundling piece is inserted disposed at a position in the vicinity of a cable drawing opening of the cover cap and held by the cooperative engagement of said grooves in the cover cap with said protruding piece edge of the plug proper.

2. The electric connector with a cable holding mechanism according to claim 1, wherein the cable bundling piece bundles a plurality of wires and comprises the flexible strip-like piece having a given width and thickness, and ratchets on one face thereof, and a retainer provided at the tip end of the strip-like piece for engaging with one of the ratchets.

3. The electric connector with a cable holding mechanism according to claim 1, wherein the grooves are defined by mutually spaced convex projections which are disposed at locations spaced wider than a width of the strip-like piece of the cable bundling piece and disposed in parallel with each other, and a height of the convex projections being substantially the same as a thickness of the strip-like piece.

4. The electric connector with a cable holding mechanism according to claim 1, wherein the grooves are defined by two inner convex projections which are wider than a width of the strip-like piece of the cable bundling piece and disposed in parallel with each other, and outer convex projections provided in the vicinity of the outside of the two inner convex projections, wherein a height of the respective convex projections is substantially the same as a thickness of the strip-like piece, and tip ends of the outer convex projections extend longer than tip ends of the inner convex projections.

5. The electric connector with a cable holding mechanism according to claim 3, wherein the respective convex projections are oppositely disposed on upper and lower wall faces of the cover cap, and the strip-like piece of the cable bundling piece is disposed between and retained by the opposite inner convex projections.

* * * * *